US009989341B2

(12) United States Patent
Robbins et al.

(10) Patent No.: US 9,989,341 B2
(45) Date of Patent: Jun. 5, 2018

(54) STUN GRENADES AND METHODS OF ASSEMBLING STUN GRENADES

(71) Applicants: Steven M. Robbins, West Haven, UT (US); Royce C. Duke, Thatcher, UT (US); Reed J. Blau, Brigham City, UT (US); James R. Hodgson, Newton, UT (US); Dixon Brockbank, Perry, UT (US)

(72) Inventors: Steven M. Robbins, West Haven, UT (US); Royce C. Duke, Thatcher, UT (US); Reed J. Blau, Brigham City, UT (US); James R. Hodgson, Newton, UT (US); Dixon Brockbank, Perry, UT (US)

(73) Assignee: Orbital ATK, Inc., Plymouth, MN (US)

( * ) Notice: Subject to any disclaimer, the term of this patent is extended or adjusted under 35 U.S.C. 154(b) by 270 days.

(21) Appl. No.: 14/692,175

(22) Filed: Apr. 21, 2015

(65) Prior Publication Data

US 2015/0345921 A1 Dec. 3, 2015

Related U.S. Application Data

(60) Provisional application No. 61/982,178, filed on Apr. 21, 2014.

(51) Int. Cl.
*F42B 12/46* (2006.01)
*F42B 12/42* (2006.01)
(Continued)

(52) U.S. Cl.
CPC ..... *F42B 12/46* (2013.01); *F42B 12/42* (2013.01); *F42B 12/48* (2013.01); *F42B 27/00* (2013.01)

(58) Field of Classification Search
CPC ..... F42B 12/36; F42B 12/00; F42B 12/50; F42B 12/48; F42B 12/42; F42B 12/44;
(Continued)

(56) References Cited

U.S. PATENT DOCUMENTS 3,678,857 A 7/1972 Evans et al.
4,324,183 A * 4/1982 Prahauser ..... C06D 3/00 102/275.3

(Continued)

FOREIGN PATENT DOCUMENTS

DE 102010052210 A1 5/2012
EP 2439483 A1 4/2012

(Continued)

OTHER PUBLICATIONS

European Search Report for European Patent Application No. 15164404.4, dated Jul. 22, 2015, 9 pages.

*Primary Examiner* — Benjamin P Lee
(74) *Attorney, Agent, or Firm* — TraskBritt

(57) ABSTRACT

Stun grenades may include a fuze configured to ignite a delay material secured to a housing including a delay chamber in which the delay material is located. A handle of the fuze may be located over a final payload chamber of the series of payload chambers, payload material in the final payload chamber being configured to ignite after ignition of payload material in each other payload chamber of a series of payload chambers. Methods of assembling stun grenades may involve positioning an obstruction in a port extending between a delay chamber and a payload chamber of a series of payload chambers surrounding the delay chamber in a housing. A delay material may be packed in the delay chamber. The obstruction may be removed, and a payload material may be positioned in the payload chamber and the port.

18 Claims, 6 Drawing Sheets

(51) Int. Cl.
*F42B 12/48* (2006.01)
*F42B 27/00* (2006.01)

(58) Field of Classification Search
CPC .. F42B 12/46; F42B 5/145; F42B 5/15; F42B 27/00; F42B 4/00; F42C 11/003
See application file for complete search history.

(56) References Cited

U.S. PATENT DOCUMENTS 4,444,111 A * 4/1984 Luebbers ..... F42B 12/36 102/334
5,085,147 A * 2/1992 Gold ..... F42B 12/36 102/486
5,561,259 A * 10/1996 Herbage ..... F42B 5/15 102/251
5,698,812 A 12/1997 Song
5,824,945 A 10/1998 Barlog et al.
6,595,139 B1 7/2003 Haeselich
6,767,108 B1 7/2004 Blachowski et al.
7,721,651 B2 * 5/2010 Lubbers ..... F42B 12/36 102/482
7,963,227 B1 6/2011 Brunn
8,161,883 B1 4/2012 Harasts et al.
8,365,668 B2 2/2013 Brunn
9,261,339 B2 * 2/2016 Mancini ..... F42B 12/42
2008/0276822 A1 11/2008 Lubbers et al.
2013/0104766 A1 5/2013 Thomas
2013/0239838 A1 * 9/2013 Kravel ..... F42B 27/00 102/487
2013/0333815 A1 12/2013 Blau
2015/0285602 A1 * 10/2015 Mancini ..... F42B 12/42 102/360

FOREIGN PATENT DOCUMENTS

GB 1139761 1/1969
WO 9408200 4/1994
WO WO 9408200 A1 * 4/1994 ..... F42B 4/16
WO WO 2012135807 A1 * 10/2012 ..... F42B 8/26
WO 2014033049 A1 3/2014

* cited by examiner

STUN GRENADES AND METHODS OF ASSEMBLING STUN GRENADES

CROSS-REFERENCE TO RELATED APPLICATION

This application claims the benefit of U.S. Provisional Patent Application Ser. No. 61/982,178, filed Apr. 21, 2014, the disclosure of which is hereby incorporated herein in its entirety by this reference.

FIELD

This disclosure relates generally to stun grenades, which are frequently used by law enforcement and military personnel to temporarily stun suspects and adversaries. More specifically, disclosed embodiments relate to stun grenades that may exhibit enhanced reliability even after being submerged in water and, in embodiments including multiple, time-delayed charges, may reduce the likelihood that ignition of one charge will prematurely, sympathetically ignite another charge.

BACKGROUND

Stun grenades, which are also referred to as "flash grenades" and "flashbangs," are nonlethal devices used by law enforcement and military personnel to stun suspects and adversaries. Stun grenades are typically configured to produce a blinding flash of light accompanied by a loud noise without causing permanent injury to those in the vicinity of a stun grenade ignition. The flash temporarily blinds and the loud blast temporarily causes loss of hearing and loss of balance in those in the vicinity when a stun grenade is ignited.

Some stun grenades, after a brief delay, ignite an entire quantity of payload material in what is referred to as a "single bang." Frequently, stun grenades are initiated by pulling a pin and releasing a handle to activate a fuze. The fuse may ignite a column of delay material, which is formulated to provide a delay before a flame front in the delay material reaches an aperture in communication with the payload material, igniting it to provide a bright flash and loud report.

Other stun grenades, after a brief delay, separately ignite several quantities of payload material in a time-delayed sequence, which is sometimes referred to as a "multi-bang." For example, U.S. Pat. No. 7,963,227, issued Jun. 21, 2011, to Brunn, discloses a stun grenade including sleeves of flash charge material encircling a central delay column. Passages that are offset from one another both longitudinally and angularly in a helical pattern extend between the delay column and the sleeves of flash charge material. As the flame front proceeds along the delay column, the passages may enable sequential ignition of the sleeves of flash charge material, resulting in multiple, separate flashes of light and accompanying bangs.

BRIEF SUMMARY

In some embodiments, stun grenades may include a housing including a longitudinal axis, a delay chamber defined in the housing proximate the longitudinal axis, and a series of payload chambers defined in the housing and surrounding the delay chamber. Each payload chamber of the series of payload chambers may include openings at opposing ends of the housing and be in communication with the delay chamber via a port extending between each payload chamber of the series of payload chambers and the delay chamber. Each port may be longitudinally and circumferentially offset from each other longitudinally adjacent port. A delay material may be located in the delay chamber, and a payload material may be located in each payload chamber of the series of payload chambers and each port. Seals may seal the openings of each payload chamber of the series of payload chambers at the opposing ends of the housing. A fuze configured to ignite the delay material may be secured to the housing in communication with the delay chamber. A handle of the fuze may be located over a final payload chamber of the series of payload chambers, and the port extending between the delay chamber and the final payload chamber may be located to cause payload material in the final payload chamber to ignite after ignition of payload material in each other payload chamber of the series of payload chambers.

In other embodiments, methods of assembling stun grenades may involve positioning an obstruction in a port extending between a delay chamber defined in a housing proximate a longitudinal axis of the housing and a payload chamber of a series of payload chambers surrounding the delay chamber defined in the housing. The payload chamber may include openings at opposing ends of the housing. A delay material may be packed in the delay chamber under above-ambient pressure. The obstruction may be removed, and a payload material may be positioned in the payload chamber and the port.

BRIEF DESCRIPTION OF THE DRAWINGS

While this disclosure concludes with claims particularly pointing out and distinctly claiming specific embodiments, various features and advantages of embodiments within the scope of this disclosure may be more readily ascertained from the following description when read in conjunction with the accompanying drawings, in which:

DETAILED DESCRIPTION

The illustrations presented in this disclosure are not meant to be actual views of any particular stun grenade or component thereof, but are merely idealized representations employed to describe illustrative embodiments. Thus, the drawings are not necessarily to scale.

Disclosed embodiments relate generally to stun grenades that exhibit enhanced reliability even after being submerged in water and, in embodiments including multiple, time-delayed charges, may reduce the likelihood that ignition of one charge will prematurely, sympathetically ignite another charge.

Figure 1:
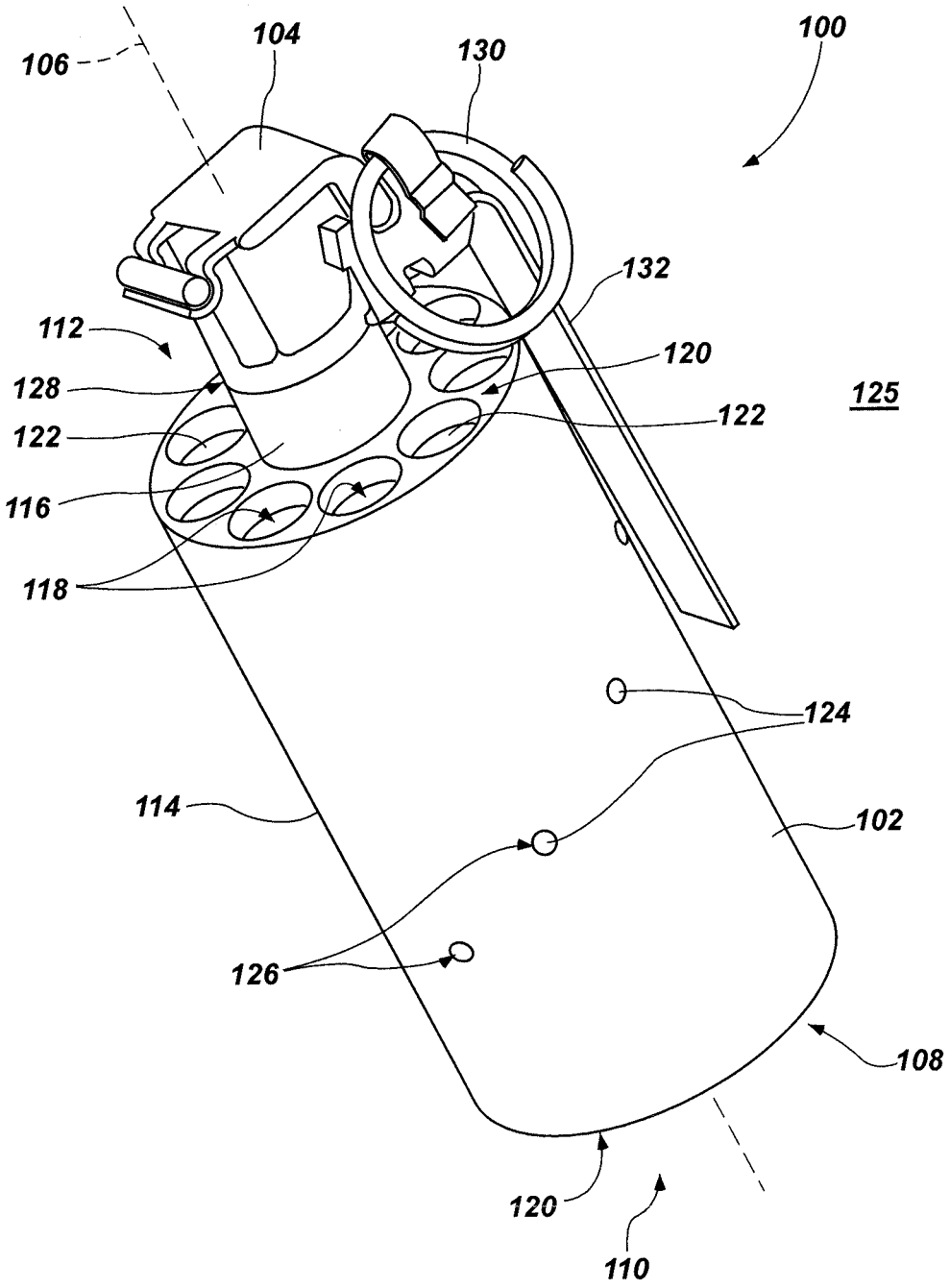
FIG. 1 is a perspective view of an embodiment of a stun grenade.

Referring to FIG. 1, a perspective view of an embodiment of a stun grenade 100 is shown. The stun grenade 100 may include a housing 102 and a fuze 104 secured to the housing 102. The fuze 104 may be configured to initiate combustible materials within the housing 102 to ignite the stun grenade 100. The fuze 104 may include a connection portion 128 configured to connect to the housing 102 and a pin 130 and handle 132 configured to cooperatively initiate the fuze 104. For example, when the pin 130 is removed and the handle 132 is released, the fuze 104 may initiate the stun grenade 100.

The housing 102 may include a longitudinal axis 106, which may be an average geometrical centerline of the housing 102 in a direction at least substantially perpendicular to a bottom surface 108 of the housing 102 or an axis of at least substantial rotational symmetry of the housing 102. The bottom surface 108 may be located on a lower end 110 of the housing 102 opposing an upper end 112 of the housing 102 at which the fuze 104 is located. The housing 102 may be, for example, generally cylindrical in shape. For example, the housing 102 may include a cylindrical main body portion 114 and a cylindrical fuze attachment portion 116, which may extend longitudinally from the main body portion 114 at the upper end 112 of the housing 102. In other embodiments, the housing 102 may be of any other shape usable for a stun grenade, such as, for example, exhibiting a hexagonal cross-sectional shape.

A series of payload chambers 118 may be defined in the housing 102. The payload chambers 118 may be distributed circumferentially around and within a periphery of the housing 102 surrounding the longitudinal axis 106. Each payload chamber 118 may extend entirely through the housing 102 (i.e., the payload chambers 118 may be at least partially defined by through-holes extending through the housing 102) such that openings 120 of the chambers 118 are located at the opposing ends 110 and 112 of the housing 102. The payload chambers 118 may be oriented at least substantially parallel to the longitudinal axis 106 of the housing 102. A seal 122 may be located in the openings 120 of each chamber 118 to reduce (e.g., eliminate) the likelihood that environmental materials (e.g., air and water) will enter the payload chambers 118 through the openings 120 to the payload chambers 118.

A port 124 defined in the housing 102 may extend from an exterior 125 of the housing 102, through each payload chamber 118, toward the longitudinal axis 106 of the housing 102. The ports 124 may be oriented, for example, at least substantially perpendicular to the longitudinal axis 106 of the housing 102. In other embodiments, the ports 124 may be oriented at an oblique angle with respect to the longitudinal axis 106 of the housing 102. For example, the ports 124 may be oriented at an angle between about 45° and about 85° with respect to the longitudinal axis 106 of the housing 102. Plugs 126 may be located in the ports 124 at the periphery of the housing 102 to reduce (e.g., eliminate) the likelihood that environmental materials (e.g., air and water) will enter the payload chambers 118 through the openings 120 to the payload chambers 118 and that material will exit through the ports 124 during a deflagration.

A material of the housing 102 may be of sufficient strength not to fragment and produce dangerous projectiles when the stun grenade 100 is ignited. For example, the housing 102 may be of a metal material. As a specific, nonlimiting example, the housing 102 may be formed (e.g., machined) from a single mass of aluminum.

Figure 2:
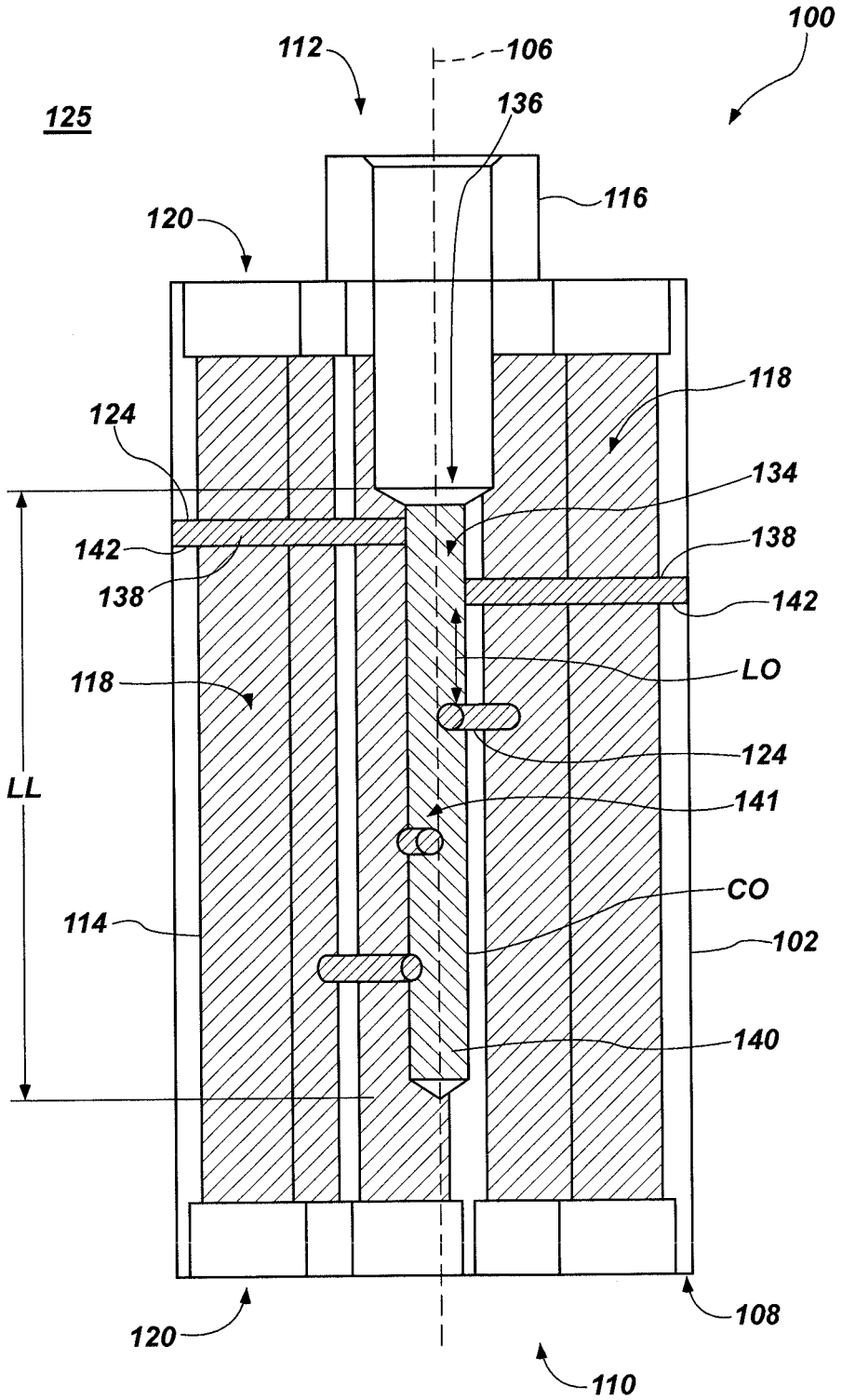
FIG. 2 is a cross-sectional view of the stun grenade embodiment of FIG. 1 in a first state.

FIG. 2 is a cross-sectional view of the stun grenade 100 of FIG. 1 in a first state. The first state may correspond to an early-stage assembly state before the stun grenade 100 is fully assembled and ready for use. When the stun grenade 100 is in the first state, the fuze 104 (see FIG. 1) may not be secured to the housing 102, the seals 122 (see FIG. 1) may not be located in the openings 120 of the payload chambers 118 at the opposing ends 110 and 112 of the housing 102, and the plugs 126 (see FIG. 1) may not be located in the ports 124 at the periphery of the housing 102. In FIG. 2, the housing 102 is displayed as being translucent to more clearly show various features of the stun grenade 100.

A delay chamber 134 may be defined in the housing 102 proximate the longitudinal axis 106 of the housing 102. The delay chamber 134 may extend parallel to the longitudinal axis 106, and may include a single opening 136 to the exterior 125 of the housing 102 (e.g., the delay chamber 134 may be at least partially defined by a blind hole in the housing 102). The delay chamber 134 may be surrounded by the series of payload chambers 118. For example, each payload chamber 118 may be located radially more distant from the longitudinal axis 106 of the housing 102 than the delay chamber 134. The delay chamber 134 may be in communication with each payload chamber 118. For example, each port 124 may extend from the exterior 125 of the housing 102, through the main body portion 114 of the housing 102 to a payload chamber 118, and extend farther inwardly through the main body portion 114 of the housing 102 to the delay chamber 134. The delay chamber 134 may also be in communication with the fuze attachment portion 116 of the housing 102. For example, the fuze attachment portion 116 may define a continuous path from the exterior 125 of the housing 102 to the delay chamber 134.

Each port 124 may be longitudinally and circumferentially offset from each other adjacent port 124 and traverse a path through main body portion 114 from an exterior surface of the main body portion 114 substantially along a radius of the cylinder of the main body portion 114 to the delay chamber 134. References to "adjacent" and "longitudinally adjacent" ports 124 in this application refer to ports 124 that are longitudinally closest to one another in terms of distance along the longitudinal axis 106. Accordingly, ports 124 that are closest to one another in terms of angular spacing, but longitudinally separated from one another by one or more other ports 124, are not adjacent to one another.

Longitudinally offsetting each port 124 from each other adjacent port 124 may cause an advancing flame front to reach each successive port 124 at a perceptibly different time, resulting in a separate and distinct ignition associated with each payload chamber 118. A longitudinal offset LO between adjacent ports 124 may be, for example, between about 5% and about 20% of a total longitudinal length LL of the delay chamber 134. More specifically, the longitudinal offset LO between adjacent ports 124 may be, for example, between about 7% and about 15% of a total longitudinal length LL of the delay chamber 134. As a specific, nonlimiting example, the longitudinal offset LO between adjacent ports 124 may be between about 8% and about 12% of a total longitudinal length LL of the delay chamber 134.

Circumferentially offsetting each port 124 from each other adjacent port 124 may reduce (e.g., eliminate) the likelihood that hot gases from one payload chamber 118 in communication with one port 124 will prematurely cause a sympathetic ignition in a payload chamber 118 in communication with an adjacent port 124, resulting in greater predictability and reliability for the time delay between ignitions in each payload chamber 118. A circumferential offset CO between adjacent ports 124 may be, for example, between about 170° and about 90°. More specifically, the circumferential offset CO between adjacent ports 124 may be, for example, between about 165° and about 120°. As a specific, nonlimiting example, the circumferential offset CO between adjacent ports 124 may be between about 160° and about 150°.

When the stun grenade 100 is in the first state (FIG. 2), an obstruction 138 may be positioned in each port 124. The obstruction 138 may occupy at least substantially an entire volume of its associated port 124. For example, the obstruction 138 may extend radially from the exterior 125 of the housing 102, through the main body portion 114 of the housing 102, through the payload chamber 118 in communication with the port 124, into a region of the main body portion 114 of the housing 102 defining the delay chamber 134. In some embodiments, a surface of the obstruction 138 closest to the longitudinal axis 106 may be flush with a surface of the housing 102 defining the delay chamber 134. In other embodiments, the surface of the obstruction 138 closest to the longitudinal axis 106 may be recessed within the port 124 proximate the surface of the housing 102 defining the delay chamber 134. For example, the surface of the obstruction 138 closest to the longitudinal axis 106 may be recessed within the port 124 by less than half a radial distance between the surface of the housing 102 defining the delay chamber 134 and the surface of the housing 102 defining the payload chamber 118 in communication with the port 124.

The obstructions 138 may be secured to the housing 102 and may reduce (e.g., eliminate) the likelihood that delay material 140 will fill the ports 124 and enter the payload chambers 118. For example, the obstructions 138 may be secured to the housing 102 at the periphery of the housing 102. More specifically, the obstructions 138 may be secured to the main body portion 114 of the housing 102 at the periphery of the housing 102 by interlocking threads in the main body portion 114 and each obstruction 138, by an interference fit, or by a shrink fit. As a specific, nonlimiting example, an end 142 of each obstruction 138 may include threads that engage with threads formed in the main body portion 114 of the housing 102 to partially define a respective port 124. The obstructions 138 may occlude the ports 124 such that delay material 140 in the delay chamber 134 does not communicate with the occluded portions of the ports 124 or with the payload chambers 118. For example, the obstructions 138 may be sized for a clearance fit between the main body portion 114 of the housing 102 defining each port 124 for the radial distance between the delay chamber 134 and each payload chamber 118. More specifically, an outer diameter of an obstruction 138 may be, for example, between about 0.001 inch (~0.03 mm) and about 0.01 inch (~0.3 mm) less than an inner diameter of its associated port 124.

When the obstructions 138 are located in the ports 124 and secured to the housing 102, the delay material 140 may be packed into the delay chamber 134. In some embodiments, the delay material 140 may be packed into the delay chamber 134 at a high pressure to increase the packing density of the delay material 140. For example, the delay material 140 may be packed into the delay chamber 134 at pressures greater than about 25 ksi (~170 MPa). More specifically, the delay material 140 may be packed into the delay chamber 134 at pressures greater than, for example, about 30 ksi (~210 MPa). As a specific, nonlimiting example, the delay material 140 may be packed into the delay chamber 134 at pressures greater than about 32 ksi (~220 MPa). In other embodiments, the delay material 140 may be positioned into the delay chamber 134 without exerting additional pressure on the delay material 140 (e.g., at atmospheric pressure).

The delay material 140 may be, for example, a combustible material formulated to ignite to form a flame front and to advance the flame front longitudinally along the delay chamber 134. More specifically, the delay material 140 may include a combustible powder, which may be packed into the delay chamber 134. As a specific, nonlimiting example, the delay material 140 may include a mixture of tungsten powder, barium chromate, potassium perchlorate, and diatomaceous earth or boron and barium chromate, which may be commercially available from Technical Ordnance Inc. of Clear Lake, S. Dak.

The delay material 140 may be formulated to burn at a selected burn rate, which, in cooperation with the longitudinal offset LO between adjacent ports 124, may result in a flame front advancing through the delay material 140 reaching each successive port 124 after a selected time delay. For example, a burn rate of the delay material 140 may be between about 0.5 inch per second (~1.3 cm/s) and about 2.0 inches per second (~5.1 cm/s). More specifically, the burn rate of the delay material 140 may be, for example, between about 0.6 inch per second (~1.5 cm/s) and about 1.5 inches per second (~3.8 cm/s). As a specific, nonlimiting example, the burn rate of the delay material 140 may be between about 0.7 inch per second (~1.8 cm/s) and about 1.0 inch per second (~2.5 cm/s).

In some embodiments, the delay material 140 may include a binder material 141 configured to hold the other components of the delay material 140 in a cohesive unit. The binder material 141 may be, for example, an organic material. More specifically, the binder material 141 may be, for example, polyvinyl acetate, alcohol resin, polyvinyl butyrate, ethyl cellulose, nylon multipolymer resin (e.g., ELVAMIDE®), polyvinyl butyral, VITON®, polyvinylidenefluoride/hexafluoropropene, or polytetrafluoroethylene. The binder material 141 may occupy, for example, between about 0.5% and about 6.0% of the delay material 140 by weight. More specifically, the binder material 141 may occupy, for example, between about 1.0% and about 3.0% by weight of the delay material 140. As a specific, nonlimiting example, the binder material 141 may occupy between about 14% and about 1.8% by weight of the delay material 140.

After the delay material 140 has been packed into the delay chamber 134, the obstructions 138 may be removed from the ports 124.

Figure 3:
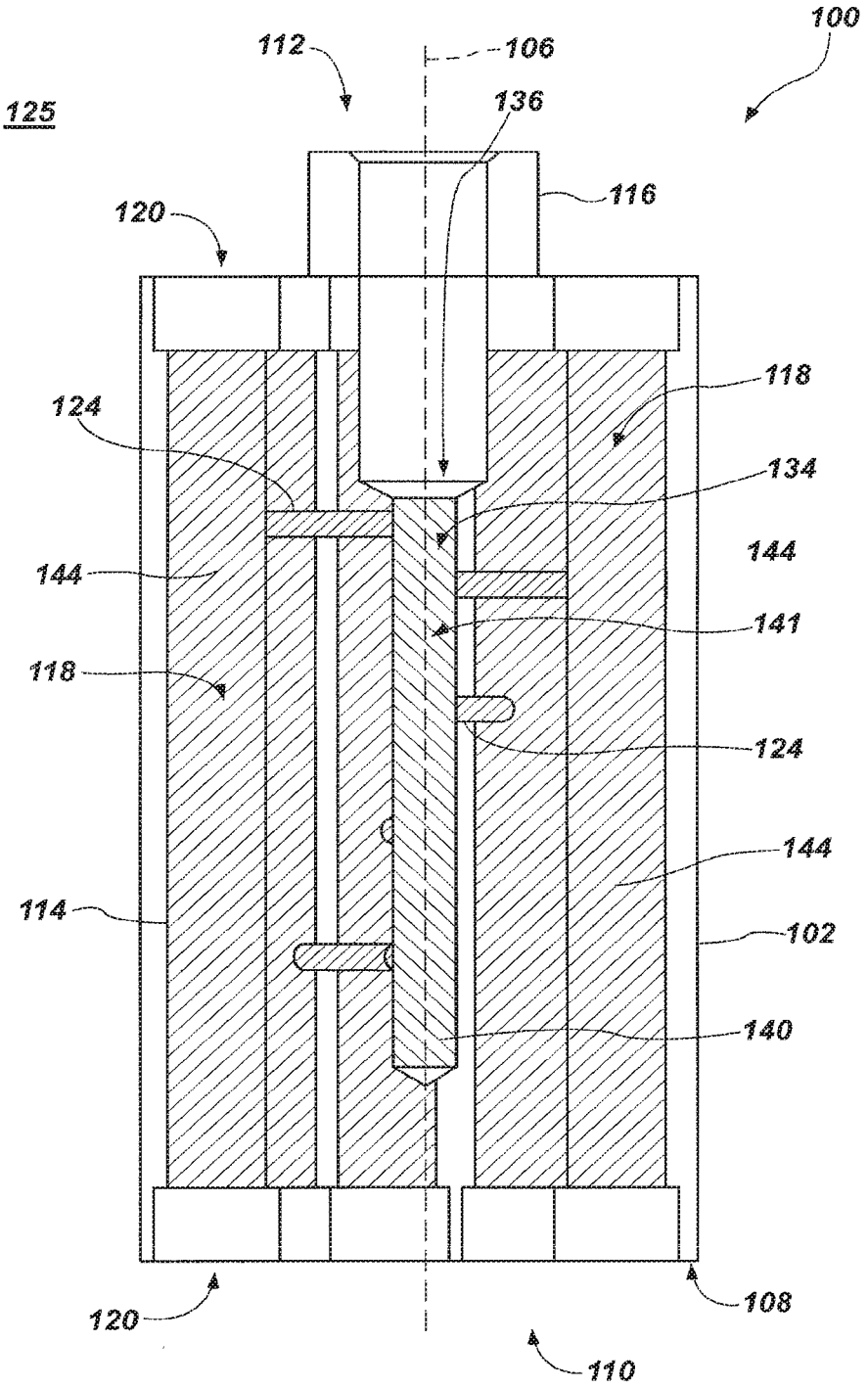
FIG. 3 is a cross-sectional view of the stun grenade embodiment of FIG. 1 in a second, subsequent state.

FIG. 3 is a cross-sectional view of the stun grenade 100 of FIG. 1 in a second, subsequent state. The second state may correspond to a later-stage assembly state before the stun grenade 100 is fully assembled and ready for use. When the stun grenade 100 is in the second state, the fuze 104 (see FIG. 1) may not be secured to the housing 102. In FIG. 3, the housing 102 is displayed as being translucent to more clearly show various features of the stun grenade 100.

Payload material 144 may be positioned in each payload chamber 118 and in the portion of each port 124 extending between the delay chamber 134 and each payload chamber 118. In some embodiments, the payload material 144 in each payload chamber 118 and its corresponding port 124 may be physically separated from the payload material 144 in each other payload chamber 118 and their corresponding ports 124, such that ignition of the payload material 144 in one port 124 and its corresponding payload chamber 118 does not sympathetically ignite the payload material 144 in any other port 124 of payload chamber 118. Such an embodiment may produce multiple, distinct, and separate flashes of bright light and blasts of loud noise, each of which may ignite at a different time from one another (i.e., may be a "multi-bang" grenade).

The payload material 144 may be, for example, a combustible powder material configured to produce a bright flash and a loud noise when ignited. For example, the payload material 144 may include an illuminant, which may include at least one fuel, at least one oxidizer, and at least one of boron and silicon, and an igniter, which may include at least one fuel and at least one oxidizer. In some embodiments, the payload material 144 may exhibit the same material composition as the delay material 140. In other embodiments, the payload material 144 may be of a different material composition from the material composition of the delay material 140. Additional details regarding formulations for payload materials 144 are disclosed in U.S. patent application Ser. No. 13/672,411, filed Jan. 7, 2013, and titled, "NONLETHAL PAYLOADS AND METHODS OF PRODUCING SAME," the disclosure of which is incorporated herein in its entirety by this reference.

In some embodiments, a peak explosion pressure exhibited by the payload material 144 may be low when compared to the peak explosion pressure exhibited by payload materials in other stun grenades. For example, the peak explosion pressure exhibited by the payload material 144 may be less than about 8 ksi (~55 MPa). More specifically, the peak internal explosion pressure exhibited by the payload material 144 may be between about 2 ksi (~14 MPa) and about 6 ksi (~41 MPa). As a specific, nonlimiting example, the peak explosion pressure exhibited by the payload material 144 may be between about 3 ksi (~21 MPa) and about 4 ksi (~28 MPa). Payload materials 144 that exhibit low peak explosion pressures, but nonetheless produce bright flashes of light and loud blasts of noise, may reduce (e.g., eliminate) the likelihood that any component of the stun grenade 100 will fragment or otherwise become a dangerous projectile.

In some embodiments, the housing 102 may be vibrated while the payload material 144 is positioned in the ports 124, the payload chambers 118, or the ports 124 and the payload chambers 118. For example, vibrating the housing 102 may enable the payload material 144 to more easily enter the ports 124 and cause the payload material 144 to exhibit a greater packing density in the ports 124, the payload chambers 118, or both the ports 124 and the payload chambers 118.

Figure 4:
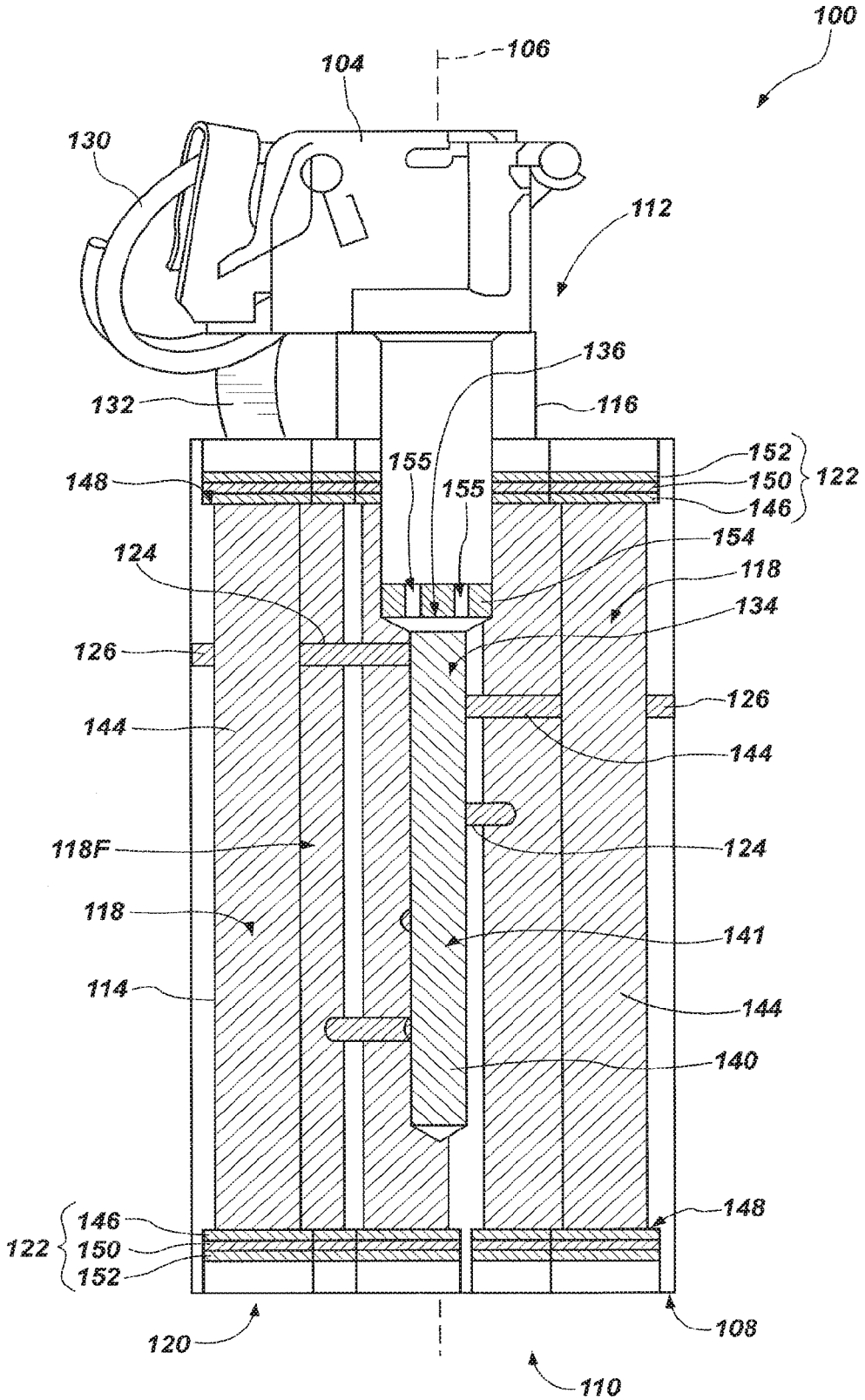
FIG. 4 is a cross-sectional view of the stun grenade embodiment of FIG. 1 in a third, final state.

FIG. 4 is a cross-sectional view of the stun grenade of FIG. 1 in a third, final state. The third state may correspond to a fully assembled state in which the stun grenade 100 is ready for use. In FIG. 4, the housing 102 is displayed as being translucent to more clearly show various features of the stun grenade 100.

In some embodiments, plugs 126 may be positioned in the outermost portions of the ports 124 after the payload material 144 has been positioned in the payload chambers 118 and the portions of the ports 124 extending between the payload chambers 118 and the delay chamber 134. In other embodiments, the plugs 126 may be positioned in the outermost portions of the ports 124 before the payload material 144 is positioned in the payload chambers 118 and the portions of the ports 124 extending between the payload chambers 118 and the delay chamber 134. The plugs 126 may be secured to the main body portion 114 of the housing 102 and may be configured to obstruct the ports 124 such that payload material 144 does not escape from the payload chambers 118 to the exterior 125 of the housing 102 through the ports 124. For example, the plugs 126 may be set screws threaded into the housing 102 at least partially defining the ports 124, or cylinders of material lodged in the ports 124 proximate the periphery of the housing 102 using an interference fit or a shrink fit.

In some embodiments, the plugs 126 may include a curable adhesive at an exterior surface of the plugs 126, which may be cured to form a seal between the plugs 126 and their associated ports 124, reducing the likelihood that environmental fluids (e.g., water and water vapor) will contaminate the payload material 144 via the ports 124. For example, the plugs 126 may be at least partially coated with curable polymer material (e.g., an epoxy resin or curable silicone), which may be cured to form a seal between the plugs 126 and their associated ports 124 after the plugs 126 have been positioned in the ports 124. When the payload material 144 is located in the payload chambers 118, the payload material 114 may be located adjacent to the plugs 126. More specifically, the payload material 144 may be in contact with at least the radially innermost surfaces of the plugs 126.

Seals 122 may seal the openings 120 to the payload chambers 118 at the opposing ends 110 and 112 of the housing 102. The seals 122 may comprise one or more suitable materials and be configured to withstand greater pressures without permitting environmental fluids (e.g., air and water) to enter the payload chambers 118, which may compromise the effectiveness of the payload material 144. For example, the seals 122 may withstand pressures greater than about 28 psi (~0.2 MPa). More specifically, the seals 122 may withstand pressures greater than, for example, about 60 psi (~0.4 MPa). As a specific, nonlimiting example, the seals 122 may withstand pressures greater than about 80 psi (~0.6 MPa). In some embodiments, one of the seals 122 may be formed at one end 110 or 112 of the associated payload chamber 118 before payload material 144 is introduced into the associated payload chamber 118. The other seal 122 may be formed at the other end 110 or 112 of the associated payload chamber 118 after payload material 144 is introduced into the associated payload chamber 118. In other embodiments, both seals 122 may be formed before payload material 144 is introduced into the associated payload chamber 118 via the port 124. In still other embodiments, both seals 122 may be formed after payload material 144 has been positioned into the associated payload chamber 118.

In some embodiments, each seal 122 may include an elastically deformable material 146 located adjacent to the payload material 144 in each payload chamber 118. For example, the elastically deformable material 146 may be secured to a lip 148 located proximate the opening 120 to the payload chamber 118 (e.g., using an adhesive). The elastically deformable material 146 may be configured to compress and expand responsive to pressures applied to the seal 122, which may render the seal 122 more resilient. Thus, when it is said that the material 146 is "elastically deformable," what is meant is that deformation of the material 146 is elastic when the material 146 is subjected to environmental pressures during normal use, which may include submerging the stun grenade 100 in a liquid (e.g., water), though the material 146 may plastically deform and even fail when the payload material 144 is ignited.

The elastically deformable material 146 may be, for example, a disc-shaped polymer material or a disc-shaped organic compound. More specifically, the elastically deformable material 146 may include a polymeric disc or cellulose fibers. As specific, nonlimiting examples, the elastically deformable material 146 may include a polystyrene disc or a paper disc (e.g., cardstock). In some embodiments in which the seal 122 includes an elastically deformable material 146, two separate discs of the elastically deformable material 146 may be located proximate the opening 120, with one disc being secured, for example, to the lip 148 and the other disc being secured, for example, to the first disc or to the sidewalls defining the opening 120.

Each seal 122 may further include a metal foil 150 located adjacent to the elastically deformable material 146 on a side of the elastically deformable material 146 opposing the payload material 144. The metal foil 150 may not be secured to the elastically deformable material 146 in some embodiments, which may reduce (e.g., eliminate) the likelihood that the seal 122 or its components will become dangerous projectiles when the payload material 144 in the associated payload chamber 118 ignites. The metal foil 150 may be, for example, a disc-shaped quantity of aluminum, which may not be an aluminum tape. More specifically, the metal foil 150 may lack an adhesive material enabling the metal foil 150 to not adhere itself to the elastically deformable material 146, which may reduce (e.g., eliminate) the likelihood that the metal foil 150 and elastically deformable material 146 will jointly be ejected during deflagration of the payload material 144 and form a dangerous projectile.

Each seal 122 may include a sealant material 152 located adjacent to the metal foil 150 on a side of the metal foil 150 opposing the elastically deformable material 146. The sealant material 152 may be secured to sidewalls of the housing 102 defining the payload chamber 118 proximate the opening 120 and to the metal foil 150. For example, the sealant material 152 may adhere itself to the sidewalls of the housing 102 defining the payload chamber 118 proximate the opening 120 and to the metal foil 150, which may enable the seal 122 to reduce (e.g., eliminate) the likelihood that environmental fluids (e.g., air and water) will pass from the exterior 125 of the housing 102 to the interior of a respective payload chamber 118. The sealant material 152 may be, for example, a water-resistant polymer material. More specifically, the sealant material 152 may include, for example, a curable silicone.

An axial thickness of the elastically deformable material 146 may be, for example, less than an axial thickness of the sealant material 152, which may reduce (e.g., eliminate) the likelihood that the seal 122 or any component thereof will fragment and become a dangerous projectile. For example, the axial thickness of the elastically deformable material 146 may be about 0.02 inch (~0.5 mm) or less. More specifically, the axial thickness of the elastically deformable material 146 may be, for example, about 0.015 inch (~0.4 mm) or less. An axial thickness of the metal foil 150 may be, for example, about 0.003 inch (~0.08 mm) or greater. More specifically, the axial thickness of the metal foil 150 may be, for example, about 0.005 inch (~0.1 mm) or greater. As a specific, nonlimiting example, the axial thickness of the metal foil 150 may be about 0.007 inch (~0.2 mm) or greater. An axial thickness of the sealant material 152 may be, for example, about 0.085 inch (~2.2 mm) or greater. More specifically, the axial thickness of the sealant material 152 may be, for example, between about 0.1 inch (~2.5 mm) and about 0.15 inch (~3.8 mm). As a specific, nonlimiting example, the axial thickness of the sealant material 152 may be between about 0.115 inch (~2.9 mm) and about 0.14 inch (~3.6 mm). In some embodiments, the metal foil 150 may exhibit a nonuniform axial thickness. For example, the metal foil 150 may be thicker at its periphery than at its central portion. In such embodiments, the "axial thickness" may refer to the maximum axial thickness of the metal foil 150.

When the stun grenade 100 is in the third state, the fuze 104 may be secured to the housing 102. The fuze 104 may be oriented to position the handle 132 of the fuze 104 over a final payload chamber 118F of the series of payload chambers 118. Payload material 144 in the final payload chamber 118F may be configured to ignite after payload material 144 in each other payload chamber 118 of the series of payload chambers 118 has been ignited. For example, the port 124 associated with the final payload chamber 118F may be located longitudinally below each other port 124 defined in the housing 102 such that a flame front advancing from the fuze 104 through the delay material 140 reaches the port 124 associated with the final payload chamber 118F only after reaching each other port 124. Orienting the handle 132 over the final payload chamber 118F may reduce (e.g., eliminate) the likelihood that expelled hot gases from the final payload chamber 118F will reflect off the handle 132 and sympathetically ignite adjacent payload chambers 118 because all other chambers 118 are positioned to ignite before the final payload chamber 118F. For example, the final orientation of the fuze 104 may be predetermined by clocking threads of the fuze 104 and threads of the fuze attachment portion 116 of the housing 102 such that the final orientation of the handle 132 of the fuze 104 is located over the final payload chamber 118F when the threads of the fuze 104 are fully engaged with the threads of the fuze attachment portion 116.

In some embodiments, the stun grenade 100 may include a restrictor 154 located between the fuze 104 and the delay material 140. The restrictor 154 may be configured to slow or otherwise interrupt the advancement of a flame front from the fuze 104 to the delay material 140, which may reduce (e.g., eliminate) the likelihood that the initial ignition of the fuze 104 will simultaneously ignite the payload material 144 located in more than one port 124 located proximate the opening 136 to the delay chamber 134. The restrictor 154 may be, for example, a disc to slow or otherwise interrupt the advancement of a flame front and holes 155 extending through the disc to enable the flame front to ignite the delay material 140.

In some embodiments, the stun grenade 100 may produce more light and sound, when considered in combination, than known multi-bang stun grenades. For example, a maximum brightness of light produced by the stun grenade 100 may be greater than about $2\times10^6$ candela. More specifically, the maximum brightness produced by a single discharge of the stun grenade 100 may be, for example, about $5\times10^6$ candela or greater. As a specific, nonlimiting example, the maximum brightness produced by the stun grenade 100 may be about $12\times10^6$ candela or greater. A pressure produced by the sound blast of the stun grenade 100, as measured six feet (~1.8 m) away from the stun grenade 100, may be, for example, about 1.1 psi (~7.6 kPa) or greater. More specifically, the pressure produced by the sound blast of the stun grenade 100, as measured six feet (~1.8 m) away from the stun grenade 100, may be, for example, between about 1.1 psi (~7.6 kPa) and about 3.0 psi (~20 kPa). As a specific, nonlimiting example, the pressure produced by the sound blast of the stun grenade 100, as measured six feet (~1.8 m) away from the stun grenade 100, may be between about 1.3 psi (~9.0 kPa) and about 2.0 psi (~14 kPa).

Figure 5:
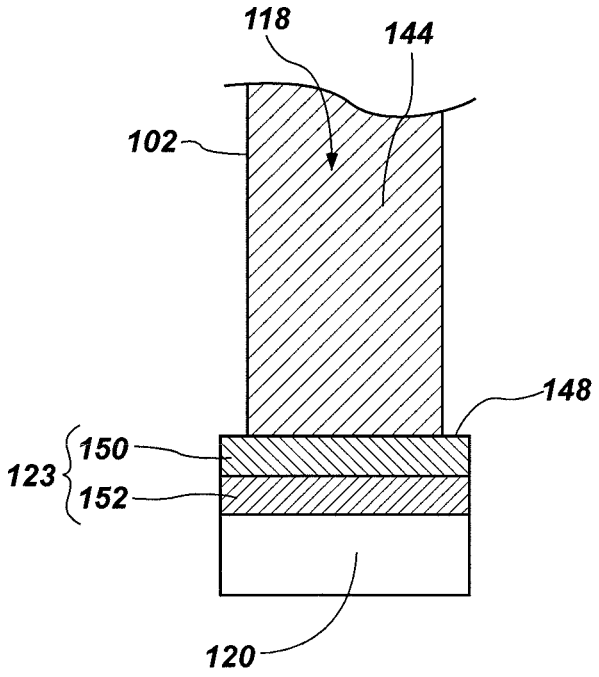
FIG. 5 is an enlarged cross-sectional view of another embodiment of a seal for sealing a payload chamber of a stun grenade.

FIG. 5 is an enlarged cross-sectional view of another embodiment of a seal 123 for sealing a payload chamber 118 of a stun grenade. In some embodiments, the seal 123 may lack any elastically deformable material 146 (see FIG. 4). For example, the metal foil 150 may be located adjacent to the payload material 144. More specifically, the metal foil 150 may be secured to the lip 148 proximate the opening 120 to the payload chamber 118, for example, using an adhesive. As another, more specific example, the metal foil 150 may be in contact with the lip 148, and may be secured in place by the sealant material 152, such that the metal foil 150 is not fastened directly to the lip 148.

As an additional, more specific example, the metal foil 150 may be in contact with the lip 148 on one side 110 or 112 of the stun grenade 100, and may be secured in place by the sealant material 152, such that the metal foil 150 contacts, but is not fastened directly to, the lip 148. When payload material 144 is positioned in the payload chambers 118, the payload material 144 may extend above the lip 148 on the other, unsealed side 110 or 112 of the stun grenade 100. The metal foil 150 may be placed directly onto the payload material 144 (e.g., such that the metal foil 150 does not contact the lip 148 on that side 110 or 112), after which the metal foil 150 may be secured in place by the sealant material 152.

Figure 6:
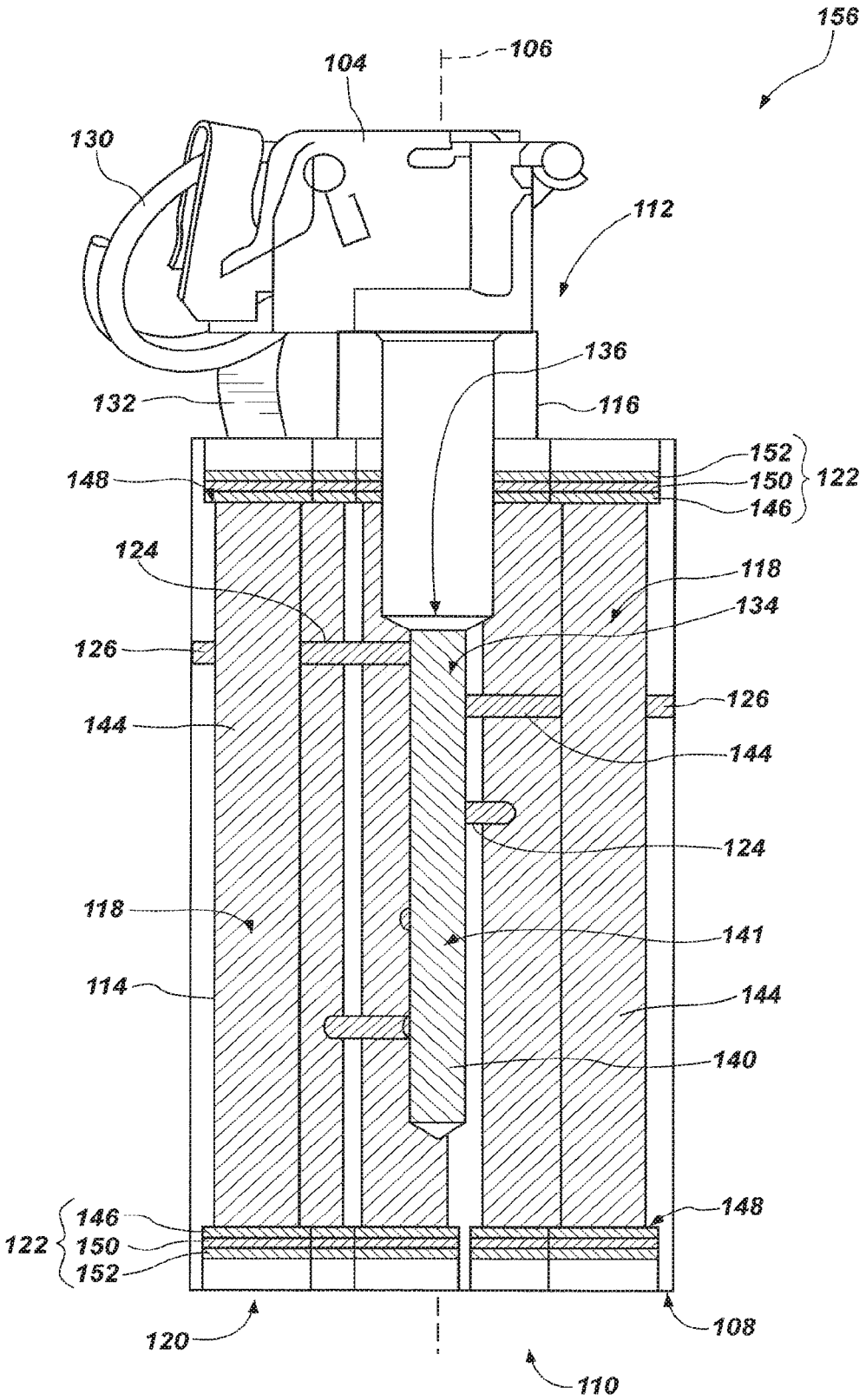
FIG. 6 is a cross-sectional view of another embodiment of a stun grenade.

FIG. 6 is a cross-sectional view of another embodiment of a stun grenade 156. The stun grenade 156 may be configured as a "single bang" device. In such embodiments, the stun grenade 156 may not include any restrictor 154 (see FIG. 4) between the fuze 104 and the delay material 140, which may enable a flame front to more quickly ignite the payload material 144 in the ports 124. A material composition of the delay material 140 may be the same as the material composition of the payload material 144 in embodiments where the stun grenade 156 is a "single bang" device. For example, each of the delay material 140 and the payload material 144 may be of the same formulations, and may exhibit the material properties, described previously in connection with the payload material 144 positioned in the payload chambers 118 and the ports 124 in connection with FIG. 3.

While certain illustrative embodiments have been described in connection with the figures, those of ordinary skill in the art will recognize and appreciate that the scope of this disclosure is not limited to those embodiments explicitly shown and described in this disclosure. Rather, many additions, deletions, and modifications to the embodiments described in this disclosure may be made to produce embodiments within the scope of this disclosure, such as those specifically claimed, including legal equivalents. In addition, features from one disclosed embodiment may be combined with features of another disclosed embodiment while still being within the scope of this disclosure, as contemplated by the inventors.

What is claimed is:

1. A stun grenade, comprising:

a housing comprising a longitudinal axis, a delay chamber defined in the housing proximate the longitudinal axis, a series of payload chambers defined in the housing and surrounding the delay chamber, each payload chamber of the series of payload chambers comprising openings at opposing ends of the housing and in communication with the delay chamber via a port extending between each payload chamber of the series of payload chambers and the delay chamber, each port being longitudinally and circumferentially offset from each other longitudinally adjacent port;

a delay material located in the delay chamber;

a payload material located in each payload chamber of the series of payload chambers and each port;

seals sealing the openings of each payload chamber of the series of payload chambers at the opposing ends of the housing, each of the seals comprising:

an elastically deformable material adjacent to the payload material;

a metal foil adjacent to the elastically deformable material on a side of the elastically deformable material opposing the payload material; and a sealant material adjacent to the metal foil on a side of the metal foil opposing the elastically deformable material; and a fuze secured to the housing in communication with the delay chamber, the fuze being configured to ignite the delay material, wherein a handle of the fuze is located over a final payload chamber of the series of payload chambers and the port extending between the delay chamber and the final payload chamber is located to cause payload material in the final payload chamber to ignite after ignition of payload material in each other payload chamber of the series of payload chambers.

2. The stun grenade of claim 1, wherein the elastically deformable material is polystyrene.

3. The stun grenade of claim 1, wherein the delay material comprises a binder material, the binder material occupying between about 0.5% and about 6.0% by weight of the delay material.

4. The stun grenade of claim 1, further comprising a restrictor comprising a disc comprising holes extending through the disc positioned between the fuze and the delay material.

5. The stun grenade of claim 1, wherein a circumferential offset between longitudinally adjacent ports is between about 170° and about 90°.

6. The stun grenade of claim 1, wherein a longitudinal offset between longitudinally adjacent ports is between about 7% and about 15% of a total longitudinal length of the delay chamber.

7. The stun grenade of claim 1, wherein each port further extends between a payload chamber of the series of payload chambers and an exterior of the housing and further comprising a plug positioned in each port, the plug being located between the payload material and the exterior of the housing.

8. The stun grenade of claim 1, wherein a burn rate of the delay material is between about 0.6 inch per second and about 1.0 inch per second.

9. The stun grenade of claim 1, wherein the delay material exhibits a different material composition from a material composition of the payload material.

10. The stun grenade of claim 1, wherein the delay material exhibits a same material composition as a material composition of the payload material.

11. A method of assembling a stun grenade, comprising:

positioning obstructions in ports extending between a delay chamber defined in a housing proximate a longitudinal axis of the housing and respective payload chambers of a series of payload chambers surrounding the delay chamber defined in the housing, each payload chamber of the series of payload chambers comprising openings at opposing ends of the housing, each port being longitudinally and circumferentially offset from each other longitudinally adjacent port;

packing a delay material in the delay chamber under above-ambient pressure;

removing the obstructions;

positioning a payload material in the payload chamber and the port;

sealing the openings of each payload chamber of the series of payload chambers at the opposing ends of the housing with seals, each of the seals comprising an elastically deformable material adjacent to the payload material, a metal foil adjacent to the elastically deformable material on a side of the elastically deformable material opposing the payload material, and a sealant material adjacent to the metal foil on a side of the metal foil opposing the elastically deformable material; and securing a fuze to the housing in communication with the delay chamber, the fuze being configured to ignite the delay material, wherein a handle of the fuze is located over a final payload chamber of the series of payload chambers and the port extending between the delay chamber and the final payload chamber is located to cause payload material in the final payload chamber to ignite after ignition of payload material in each other payload chamber of the series of payload chambers.

12. The method of claim 11, wherein positioning the obstruction in the port comprises temporarily securing an end of the obstruction to the housing.

13. The method of claim 11, wherein packing the delay material in the delay chamber under above-ambient pressure comprises packing the delay material in the delay chamber at a pressure greater than about 30 ksi.

14. The method of claim 11, further comprising vibrating the housing while positioning the payload material in the port.

15. The method of claim 11, further comprising positioning a restrictor comprising a disc comprising holes extending through the disc between the fuze and the delay material.

16. The method of claim 11, wherein each port further extends between a payload chamber of the series of payload chambers and an exterior of the housing and further comprising positioning a plug in each port between a payload chamber and the exterior of the housing before positioning the payload material in each payload chamber of the series of payload chambers.

17. The method of claim 11, further comprising selecting the delay material to exhibit a burn rate of between about 0.6 inch per second and about 1.0 inch per second.

18. A stun grenade, comprising:

a housing comprising a longitudinal axis, a delay chamber defined in the housing proximate the longitudinal axis, a series of payload chambers defined in the housing and surrounding the delay chamber, each payload chamber of the series of payload chambers comprising openings at opposing ends of the housing and in communication with the delay chamber via a port extending between each payload chamber of the series of payload chambers and the delay chamber, each port being longitudinally and circumferentially offset from each other longitudinally adjacent port;

a delay material located in the delay chamber;

a payload material located in each payload chamber of the series of payload chambers and each port;

seals sealing the openings of each payload chamber of the series of payload chambers at the opposing ends of the housing, wherein each seal comprises:

an elastically deformable material adjacent to the payload material;

a metal foil adjacent to the elastically deformable material on a side of the elastically deformable material opposing the payload material; and a sealant material adjacent to the metal foil on a side of the metal foil opposing the elastically deformable material;

a fuze configured to ignite the delay material secured to the housing in communication with the delay chamber; and a restrictor configured to slow or otherwise interrupt the advancement of a flame front from the fuze to the delay material located between the fuze and the delay material.

* * * * *